United States Patent [19]

McCray et al.

[11] 4,400,104

[45] Aug. 23, 1983

[54] SHUTTLE PRINTER AND DRIVE MECHANISM

[75] Inventors: Charles M. McCray, Raleigh, N.C.; William A. Grubbs, Rockville, Md.

[73] Assignee: International Business Machines Corp., Armonk, N.Y.

[21] Appl. No.: 333,598

[22] Filed: Dec. 23, 1981

[51] Int. Cl.[3] ..... B41J 25/28; B41J 19/18

[52] U.S. Cl. ..... 400/320; 400/121

[58] Field of Search ..... 74/25, 26, 44; 400/320, 400/322, 121

[56] References Cited

U.S. PATENT DOCUMENTS

| | | | |
|---|---|---|---|
| 1,857,352 | 5/1932 | Cannon | 74/44 |
| 2,963,854 | 12/1960 | Meijer | 74/44 X |
| 3,861,510 | 1/1975 | Wilczewski et al. | 400/124 |
| 3,930,415 | 1/1976 | Hoganson | 74/25 X |
| 4,127,334 | 11/1978 | Watanabe et al. | 400/124 |

FOREIGN PATENT DOCUMENTS

| | | | |
|---|---|---|---|
| 44415 | 1/1982 | European Pat. Off. | 400/320 |

*Primary Examiner*—Edgar S. Burr
*Assistant Examiner*—David A. Wiecking
*Attorney, Agent, or Firm*—Edward H. Duffield

[57] ABSTRACT

A shuttling printer mechanism suitable for use with dot forming print elements is disclosed. A mechanical linear reciprocable drive apparatus acting as close as possible through the center of percussion of the print head and suspension assembly reciprocates the print head back and forth along a desired print line adjacent to a platen. The drive apparatus utilizes a unique non-circular gear arrangement. The suspension and frame design is adapted to provide print line visibility so that printed characters may be seen as they are formed. The reciprocation drive operates without orthogonal forces. It provides a purely linear drive force so that the machine is free of unwanted vibrations in other planes or axes.

1 Claim, 10 Drawing Figures

CY
MS
-0.25
-27.77
0
0
9.275
46.275
0.5
55.55
1.0
111.11
lb
GR
2
908
1.73
785
FORCE TO LEFT
1
454
SPRING LOAD 0
FORCE TO RIGHT
1
454
2
908
FORCE REQUIRED
1.08
491
CARRIER INERTIA
0
FORCE RETURNED
1.08
491
INCREMENTER LOAD
0
.38
174
PRINT DRAG
0
PRINT 37MS
CTR
RT
CTR
LFT
CTR
RT
CTR

SHUTTLE PRINTER AND DRIVE MECHANISM

RELATED APPLICATIONS

This application is related to copending application Ser. No. 333,599, filed simultaneously herewith and commonly assigned herewith.

FIELD OF THE INVENTION

This invention relates to dot matrix printers in general and to drive mechanisms for oscillating the print head carrier or suspension systems therein.

PRIOR ART

A wide variety of dot matrix print mechanisms are known, of course. Those employing a shuttle principle in which print heads are affixed to a movable carrier are commonplace, but those in which the print heads and the carrier move together as a single piece are relatively few. Only U.S. Pat. No. 4,127,334 is presently known to the applicant for this latter type of design.

This patent utilizes a generally E-shaped pair of flexible spring elements to support a rigid frame on which are mounted one or more print heads for reciprocation along a printing line. The E-shaped spring elements are known to provide a linear translation when the top and bottom legs of the E-shaped springs are anchored to framework and the center leg is flexed back and forth. Two sets of such E-shaped springs are employed in this known patent, with the print head framework being affixed to the center legs of the E-shaped springs. This obscures the printing since the line of print produced is in a lower vertical position than the top of the springs. There is one set of springs at each end of a general printing region. This patent also includes an off-center crank reciprocating driving means operating as an ordinary connecting rod and crank mechanism. This mechanism introduces forces which are not in the desired line of travel and hence introduces unwanted vibrations in a direction perpendicular to the desired printing line. In addition, this patent employs compound springs built up from several pieces requiring mechanical affixation and interconnection with the other elements such as the print head mounting framework. Also, it requires additional frame elements for mounting the springs themselves. The complex assembly of multiple pieces is subject to requiring periodic adjustment, may involve additional manufacturing and maintenance expense, and may also produce a higher degree of unreliability due to the numerous parts and concommitant potential areas for mechanical failure.

OBJECTS OF THE INVENTION

In view of the foregoing difficulties with the known prior art, it is an object of this invention to provide an improved shuttling printer in which the shuttle and suspension do not obscure the printing line.

An additional object of the present invention is to provide an improved reciprocable drive mechanism for a printer which provides purely linear acceleration forces in direct axial alignment with the motion of the shuttle framework along the printing line.

SUMMARY

The foregoing and still other objects not enumerated are met in the present invention by providing a cantilever spring and shuttle framework assembly for supporting one or more print heads. In addition, a unique non-circular gear drive linear reciprocating apparatus is directly connected to the shuttle framework to provide colinear pure acceleration forces free of unwanted vibrations in other planes and axes. A one-piece plastic molding having two generally E-shaped plate spring end panels is used.

This one-piece compound spring and framework is mounted to the frame of the printer housing by a rigid attachment with the center legs of the E-shaped spring panels. This mounting is contrary to that shown in prior art printers of this type. This improvement provides print line visibility. The print head framework joined by the two E-shaped spring elements positions the print heads generally colinear with the top most legs of the E-shaped springs. This brings the print line up near the top of the printing mechanism for easy visibility of the resulting print.

An improved mechanical driving system employing non-circular gears to provide nonlinear acceleration functions to exactly match the desired velocity profiles for such a shuttling printer mechanism is described in this specification. This latter feature, together with the aspect of mounting the print head or heads or the topmost portion of the E-shaped spring elements is separately claimed by the inventors herein. The molded springs and frame were shown for convenience in the preferred embodiment described in a co-pending application filed simultaneously herewith in Application Ser. No. 333,599. These features were described therein as a convenience in showing the overall development of the printer as well as the basic invention of that application dealing with the one-piece molded plastic suspension and framework, the cooling aspects and the linear voice coil electronic drive mechanism.

The invention will now be described with regard to a preferred embodiment showing the best mode contemplated for utilizing the invention as shown in the accompanying drawings as follows.

DETAILED SPECIFICATION

Figure 1:
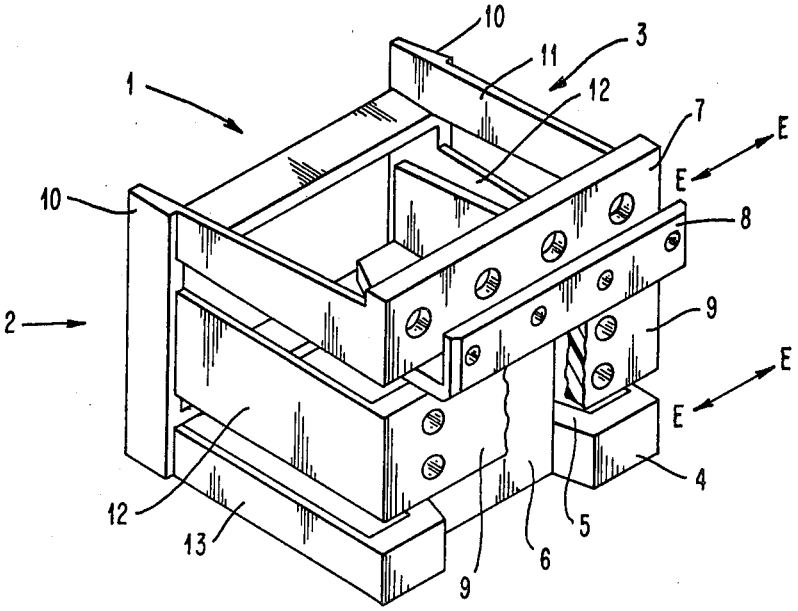
FIG. 1 illustrates a pictorial view of the one-piece molded plastic print head suspension, compound cantilever spring and head mounting frame element.

The print head suspension framework and mounting system which is depicted in FIG. 1 is an integrally molded single piece of plastic. The design was originated to obtain the lowest possible cost. The design requires, due to the flexing of the E-shaped cantilever spring members, a relatively low tensile modulus material in order to keep the spring rate as low as possible since the spring loads will be reflected as loads on the mechanical driver system. However, the creep modulus of the selected material must be sufficiently high so as minimize cold flow problems. A number of materials were surveyed and parts were modeled. The most effective material is a polysulfone having a creep modulus of 325 KPSI at 70° F. and a 4 KPSI load, a tensile modulus of $3.54\times10^5$ PSI and a specific gravity of 1.37. Other suitable materials are polyester and copolymers of engineering structural polymer. In general, the desired materials must have 1.1 to 1.4 specific gravity, $3.4\times10^5$ PSI minimum tensile modulus and a creep modulus of 320 KPSI minimum at 73° F. and 1.5 KPSI load.

Turning to FIG. 1, the one-piece molded print element shuttle suspension and frame member 1 is seen to comprise two relatively E-shaped cantilever spring elements at the ends 2 and 3, respectively.

The molded E-shaped spring members are made such that each member 2 and 3 has first, second and third legs numbered 11, 12 and 13, respectively. Legs 12 are made twice the width of legs 11 and 13 so that the combined spring rate of the outer leaves 11 and 13 exactly equals that the center leaf 12. The outer ends forming the vertical bar of the E-shape on each of the spring suspension members 2 and 3 are formed together in a common piece 10.

Print head carrier frame 7 and aligning member 8 are integrally molded with the spring suspension system. A connector bar 6 connecting the upper framework elements 7 and 8 to the lower framework elements 4 and 5 assures that elements 4, 5, 7 and 8 will move together in reciprocation. The oscillatory drive means applies reciprocating forces along the line EE in FIG. 1. This means will be described in greater detail below.

Elements 7 and 8 are shown with alignment holes for accepting wire matrix print heads. It is equally advantageous to employ ink jet dot printers, thermo electric printers, and the like. The holes shown in members 7 and 8 are therefore only indicative of the relative positions of a plurality of dot forming heads which may be carried by members 7 and 8.

The frame piece 9 is integrally molded with the E-spring elements and is affixed to the center legs 12 of each E-shaped spring end piece 2 and 3, respectively. Frame piece 9 is affixed to rigid framework in the printing machine mechanism not shown. Thus, the center legs 12 are rigidly anchored by the attachment frame members 9 to a mechanical ground.

The element 5 may have attached to it an optical timing emitter in the form of an apertured grid strip. This serves as a timing emitter of the well known sort normally employed in wire matrix or dot matrix printers to give appropriate timing pulses for use in an electronic control system for synchronizing the firing of the dot matrix solenoids or the like to construct the desired characters.

Figure 2:
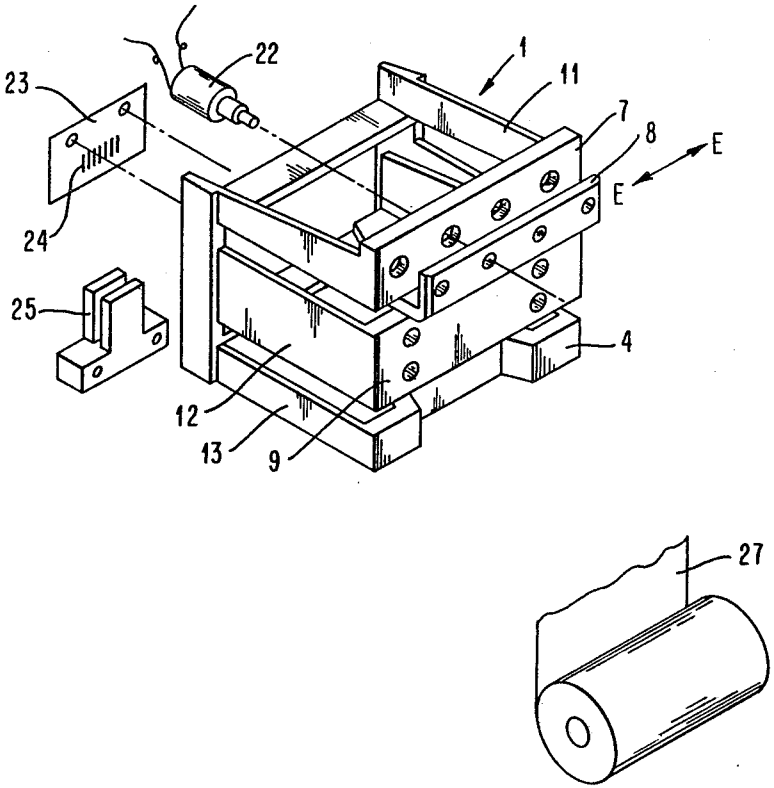
FIG. 2 illustrates an exploded schematic view of the major components for the printer utilizing the one-piece molded suspension and spring assembly.

Turning to FIG. 2, the overall major components of a preferred embodiment of a dot matrix printer mechanism utilizing the integrally molded spring framework suspension and carrier assembly 1 are shown.

An individual print element 22 is shown positioned coaxially with a set of the apertures in the frame member 7 and 8, it being understood that one or more such print heads 22 may be employed and that they may be of any of a variety of types. An emitter aperture grid 23 containing numerous apertures or slots 24 may be affixed to member 4 or 5 (not visible in FIG. 2) for oscillation back and forth with the carrier and suspension. The emitter grid 23 may pass between the typical photo source and sensor mounting block 25. Block 25 contains a light emitting diode and a photo sensor on opposite sides of a slot through which the emitter grid 23 reciprocates in a well known fashion.

A fixed platen 26 is shown positioned adjacent the printing area where the print head 22 will be reciprocated. Paper feed rolls 20A and 20B (FIG. 3) can, through a normal friction feeding engagement with a paper supply 27, cause the paper to increment by one dot height. It is necessary to feed the paper supply at the end of each reciprocating stroke of the carrier to begin printing a new dot row. This is done by means to be described later.

Figure 3:
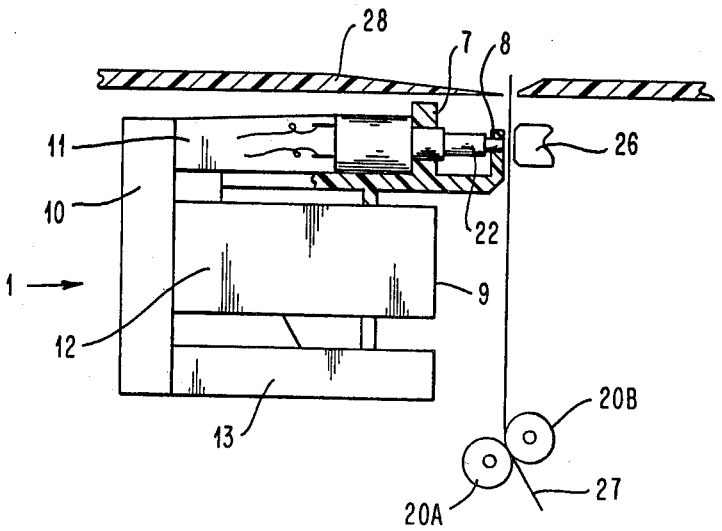
FIG. 3 illustrates a schematic cross-sectional view taken toward the edge of the paper in a printer constructed according to the general scheme shown in FIG. 2.

Turning to FIG. 3, a schematic cross section of the major elements depicted for the assembly in FIG. 2 is illustrated. As may be seen, the feed rolls are shown as roll pair 20A and 20B which frictionally grip and drive the paper 27. The cantilever suspension assembly 1 is rigidly affixed by the frame piece 9 attached to the center leg 12 of each of the E-shaped spring members. The molded framework 7 and 8 are shown together in a mere schematic representation. The print heads 22 would be coplanarly arranged with respect to the printing surface on platen 26 as indicated. They may form a colinear or vertically staggered array if desired. An overall cover which may incorporate a plastic tearing knife or guide bar 28 is also shown.

Figure 4:
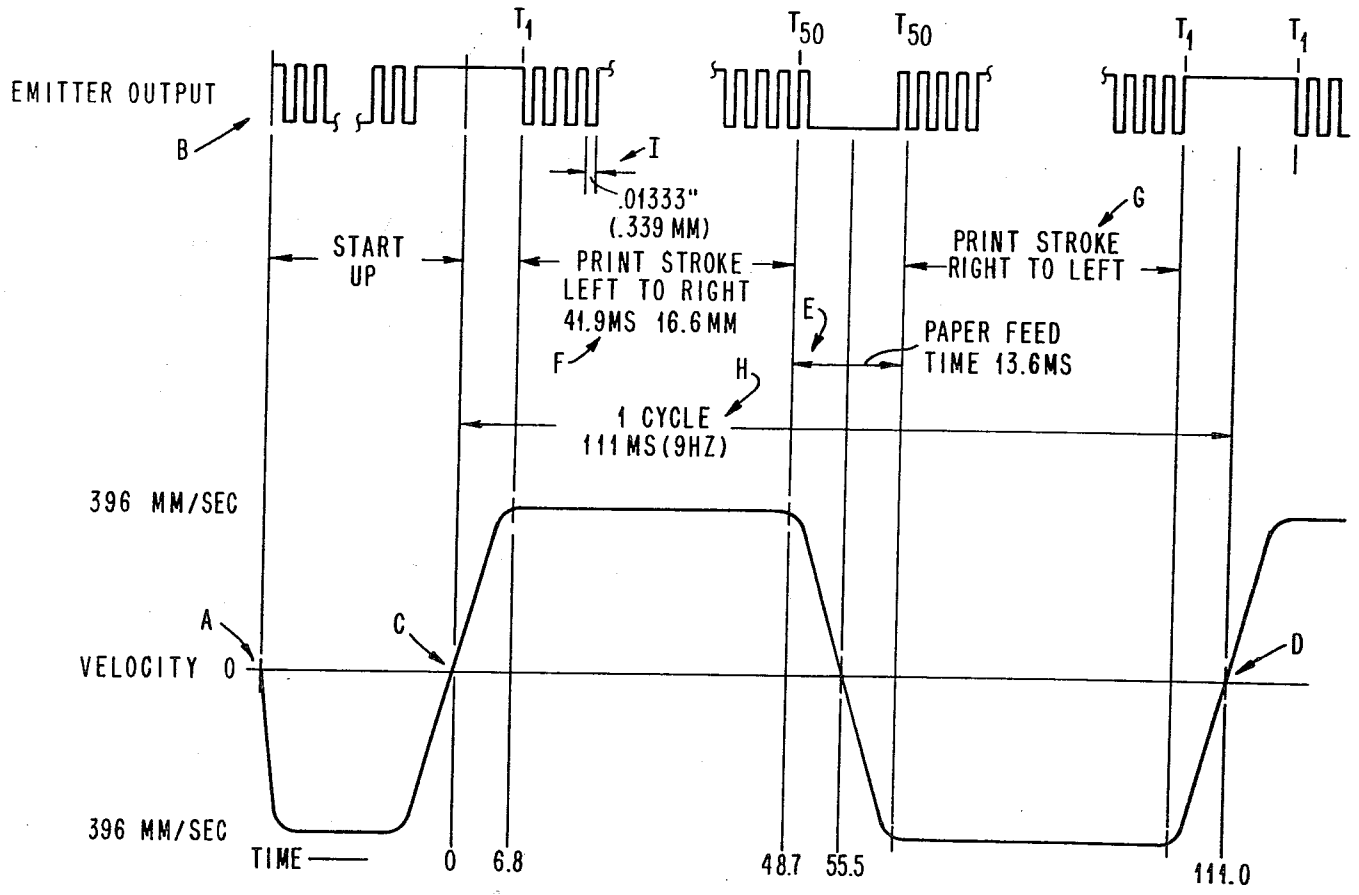
FIG. 4 illustrates the emitter output, velocity of the print head and direction of travel for several half cycles of operation.

Turning to FIG. 4, a timing diagram for a preferred embodiment of the printer as schematically illustrated in FIGS. 2 and 3 is shown.

In FIG. 4 line A illustrates a velocity versus chart time. An initial "set-up" time between point A and point C during which the onepiece molded carrier and print head assembly is accelerated from 0 to 396 millimeters per second velocity is shown. This time period may be arbitrary, but typically requires approximately 20 milliseconds. From point C to point D on line A, one full cycle of printing consisting of a left to right and a right to left printing stroke is indicated. The elapsed time of 110 milliseconds is arbitrary and of course longer print lines or greater or lower speeds might be employed. The desired printing stroke covers approximately 16.6 millimeters which is sufficient to encompass 10 dot matrix characters of 5 dots of primary width each.

As shown by section E in FIG. 4, a brief period at the end of each printing stroke left to right or right to left is allowed for paper feeding time (approximately 13.6 milliseconds) as shown. The left to right and right to left print strokes are indicated in sections F and G, respectively, and are truncated to show only a few of the 50 emitter pulses on line B which would be desired. Between the times labeled $T_1$ and $T_{50}$, these emitter pulses would be produced by the aperture emitter 23 shown in FIG. 2. Each emitter pulse has a total duration which corresponds to a distance of approximately 0.339 millimeters of lateral travel. Wire firing for wire matrix print heads can be easily timed as well-known in the art to the rising or falling edge of such pulses produced by an emitter.

Figure 5:
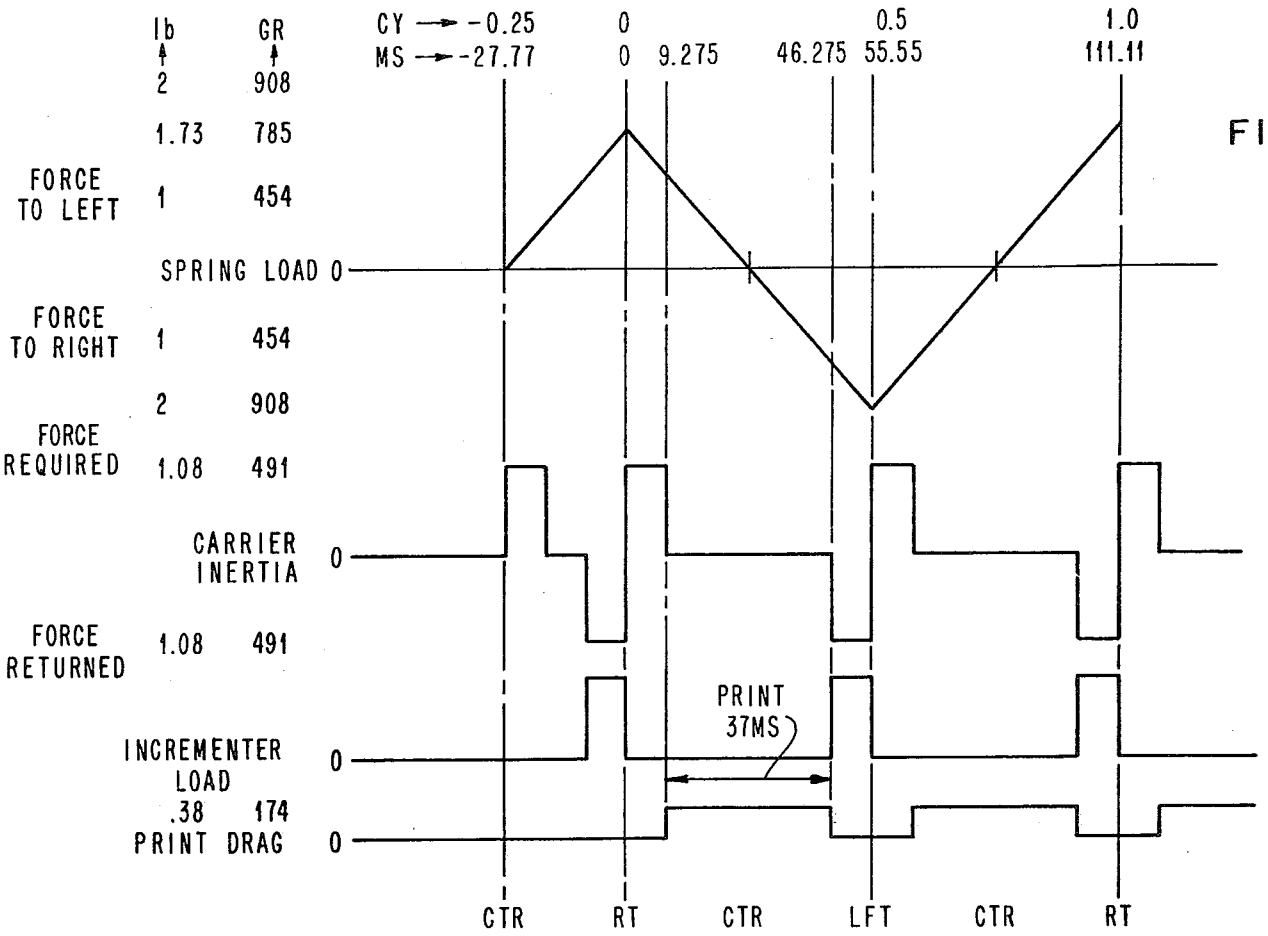
FIG. 5 is a force and displacement chart for operation of the mechanism shown in FIG. 2 over a complete cycle of oscillation from left to right and back.
Figure 6:
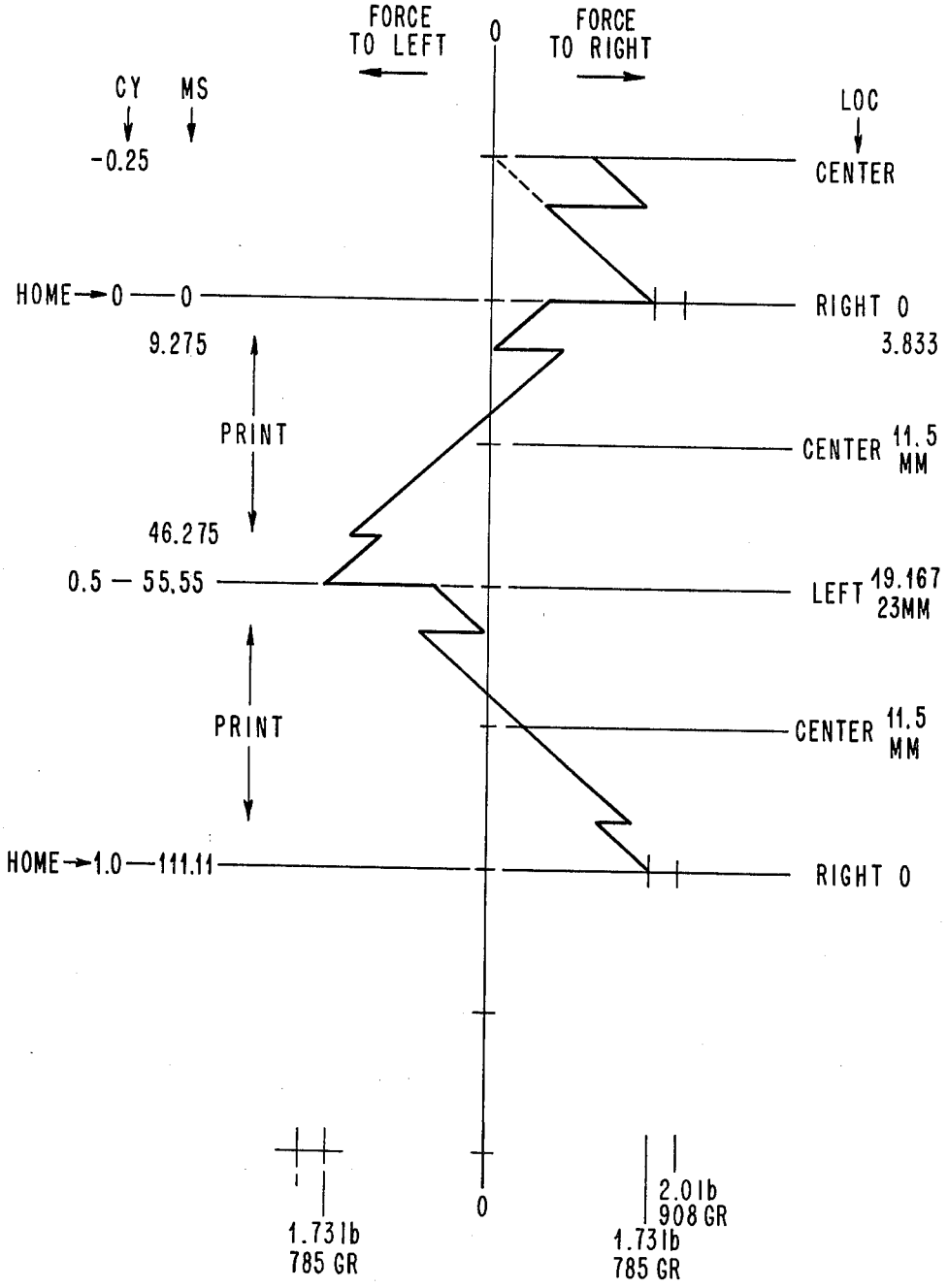
FIG. 6 is a force and displacement chart for the forces to be generated by the mechanism drive the carrier assembly.

FIG. 5 illustrates the spring loading forces moving right and left including the forces occasioned by the paper incrementer mechanism. These forces must be supplied by the driving mechanism and result in the total force shown in FIG. 6 for one complete cycle from right to left and back to the right again. As may be understood, when the spring carrier suspension mechanism is deflected to the right or left of center, energy stored in the spring is released. Thus, for at least a portion of the return stroke, the mechanism need not supply as much force. However, after crossing the center or 0 force position, additional energy must be supplied to deflect the spring in the opposite direction. When these forces are provided at or near the natural period of vibration for the spring suspension system, some efficiency in operation results.

If the frequency of oscillation of reversal applied to the suspension is adjusted to be at or approximately the same as the natural period of vibration of the spring and carrier mass suspension system, very small additional forces are required in order to keep the system in motion. These are chiefly those forces which are extracted by the paper incrementing mechanism near each end of the travel from left to right or right to left. Frictional losses are minimum since there are no bearings, pivots, slides, etc. Frictional losses due to air motion are the primary source of loss other than the direct mechanical loss due to extraction of force by the paper incrementing mechanism previously mentioned.

Figure 7:
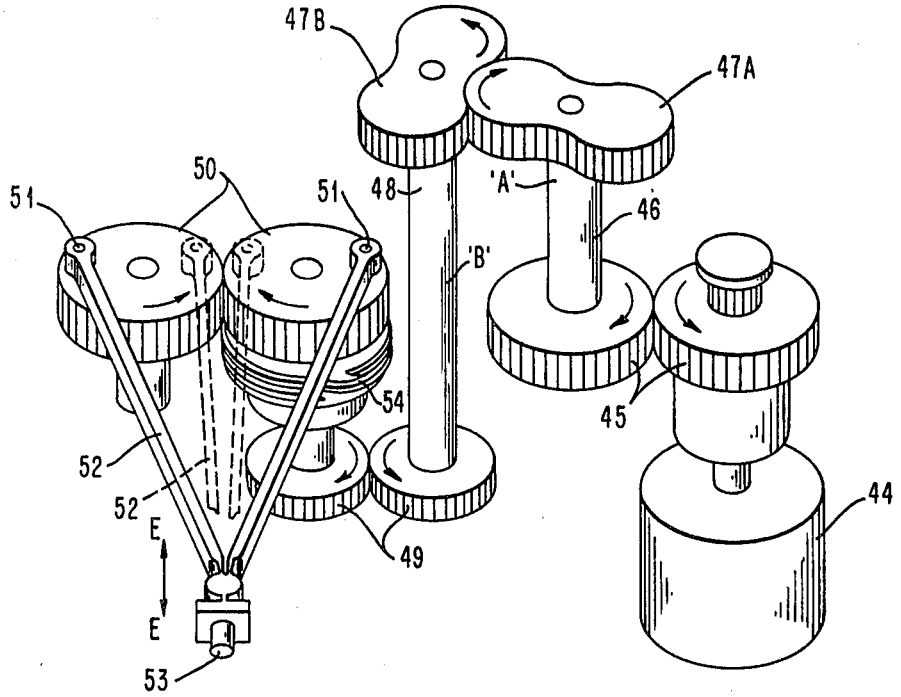
FIG. 7 illustrates the preferred reciprocating drive mechanism utilizing non-circular gears to provide an irregular angular velocity and provide abrupt transitions in direction with a smooth and linear velocity profile intermediate the transitions.

FIG. 7 illustrates an improved mechanical gear and reciprocating crank mechanism of the present invention to replace the voice coil driver in our copending application. A motor 44 supplies a uniform velocity or continuous rotary output through the matched circular gear set 45 to shaft 46. Shaft 46 also carries the first of a non-circular gear set 47A and 47B. The constant angular velocity output at shaft A is converted into an irregular angular velocity output by the non-circular gear set 47A and B to provide an irregular angular velocity output on shaft B labeled 48. The one to one circular gear set 49 applies this irregular velocity to a matched circular gear set 50 through the shaft. In the circular gear set 50, each gear is supplied with a driving pin 51 connected to or journalled in individual arms of a flexible plastic connecting rod or yoke 52. This yoke 52 provides a direct linear output with no component of force orthogonal to the direction of travel at its output on line EE point 53.

A helical thread mounted on a drum 54 operates with fixed interposer pins attached to an incrementing wheel (not shown) to increment the wheel by one thread pitch length on the helix 54 with each rotation of the shaft. Each full rotation of the shaft provides an increment at the beginning of a rotation (end of the previous rotation) and another increment half-way through a revolution. Thus, the helical thread is configured to present a cam surface which is not sloped for approximately one-half of a revolution and then it is stepped upward by the distance equal to a given dot row height representing the end of one left to right or right to left stroke at the output 53. This will increment the paper by one dot height. Then, with continued rotation of the shaft, a further increment will occur at the end of the return stroke. These details of the helical thread path on drum 54 would be obvious to one of ordinary skill in the art and are not described further.

Figure 8:
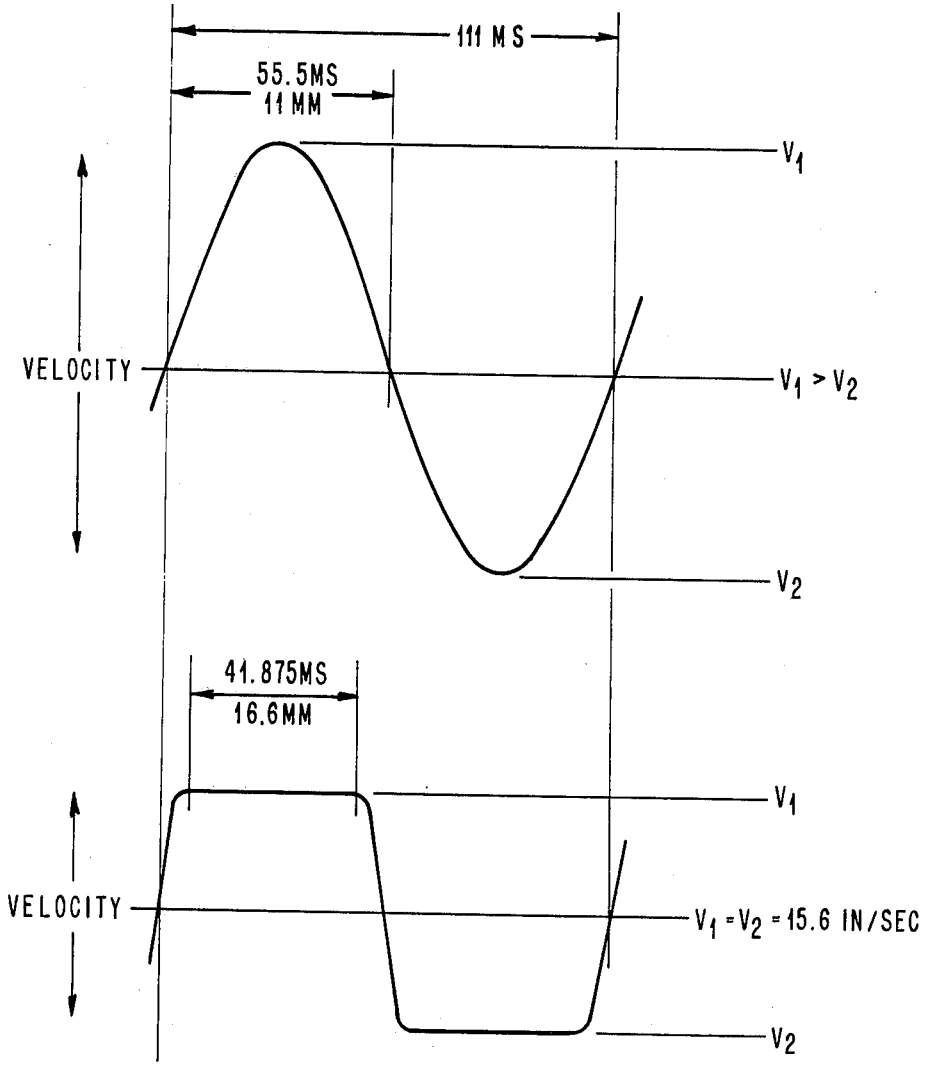
FIG. 8 is a comparison of the velocity output profile developed by the mechanism depicted in FIG. 7 as contrasted with normal circular gearing output results.

The flexing drive coupling member 52 can be molded of plastic to reduce cost as is done in the preferred embodiment. The non-circular gear set 47A and 47B is utilized to better control the output motion at point 53. The velocity profile obtained differs substantially from that that would be obtained with normal circular gearing. FIG. 8 illustrates the difference.

In FIG. 8, the upper curves illustrate the tracing obtained of velocity and time given a normal circular gear set with an input drive rotating at 540 RPM which yields approximately nine cycles per second or 111 milliseconds per cycle. The velocity labeled V1 is slightly greater than V2 from the effect of the crank pin and angular thrust output being different at one end of the throw from the other as is well known in the mechanical arts.

Figure 9A:
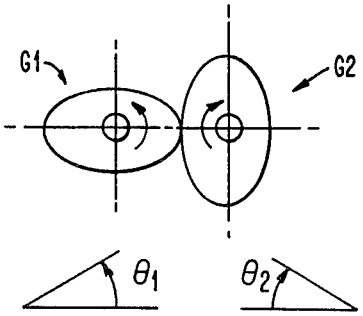
FIGS. 9A and 9B schematically illustrate the nomenclature and measurement conventions adopted for describing the non-circular gear set values in connection with Appendix Table I.
Figure 9B:
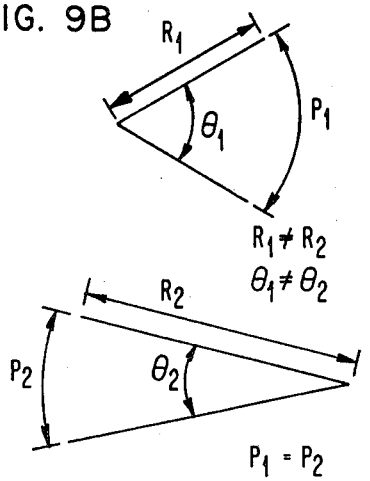

The lower portion of FIG. 8 illustrates the velocity profile versus time that may be obtained with the non-circular gearing shown in FIG. 7. Initial high velocity acceleration rates followed by a flat sustained velocity and an abrupt but smooth transition to the opposite direction are shown. The velocity profiles can be designed so that the maximum V1 and V2 velocities are equal and that the velocity is maintained at a very steady rate over the interval of a print line which is most desirable. The non-circular gear set comprises two identical gears of non-circular form. They are so designed that the sum of radii measured from each gear center to their common mesh point is constant. In the case illustrated, the constant is 30 mm. This can be verified in Appendix Table I by adding the radii R1 and R2 at each degree of rotation measured as $\theta$ for gear 1 in the Table. A full set of radius values for each gear in one-degree increments for 0 through 360 is listed in the Table. For gear 1, $\theta$ is zero when the longest diameter is horizontal in the small FIG. 9A. Since each gear will rotate by an amount that will produce an equal peripheral travel and R1 does not equal R2, it follows as shown in FIG. 9B that $\theta_1$ does not equal $\theta_2$ for most gear positions. The starting position is shown in FIG. 9A with gear 1 set with its longest axis horizontal and defined as 0 degrees rotation for purposes of this description. Also for purposes of description, gear 1 in FIG. 9A is assumed to rotate counter clockwise. Gear 2 will be engaged with a slight amount of pre-rotation in the clockwise direction as shown in FIG. 9A and in the first entry in Table I as 1.49198681 degrees of rotation (measured in this case relative to the gear's shortest axis positioned horizontally). The other Table entries follow the same format under each degree of rotation for gear 1. The entries are Degree of rotation $\theta 1$, Gear designation: (gear 1), R1 (tangent radius for gear 1), $\theta 2$ degree of rotation for gear 2, and R2 (tangent radius for gear 2). Further details of the non-circular gear set employed in the preferred embodiment are given below in the Appendix, Table 1 which shows the radius of the gears as a function of angular rotation for one full 360° arc. These gears can be of molded plastic for quiet operation and low cost manufacture. This arrangement has the novel result of achieving a flat velocity profile across the print line distance. This is of interest in providing high forces for the incrementing function without the limitation of requiring these forces to be extracted from the maximum ends of travel of a voice coil as shown in our copending application where the force available requires higher currents at these points.

The flexing V-shaped coupling element 52 provides the unique result of counter balancing any orthogonal forces. The two counter rotating gears provide orthogonal forces that directly cancel in the V flex coupling 52. Only the resultant straight linear thrust along the axis of symmetry midway between the two shafts of the output gears are produced along the line shown at the output coupling 53.

This mechanical design for the drive mechanism has the additional advantage in that the motor 43 can supply at its output pulley a continuous or uniform rotary drive for driving printing ribbon and the like without the necessity of the more complex stepwise camming and incrementing arrangement necessary with the voice coil prime driver design described in our copending application. However, the voice coil design in our copending application is easily constructed with a minimum of mechanical cost and complexity and provides a basically electronically controlled mechanism. Either drive may be satisfactorily employed in the preferred embodiment provided that appropriate spacings in the emitter grid are used to adjust the the aforementioned velocity profile differences. It will be understood that the non-constant velocity output of the voice coil is not a detriment in such operations since actual wire firing timings for printing the dots are derived from a physical displacement registered by the emitter grid.

TABLE I

| | | APPENDIX | | |
|---|---|---|---|---|
| $\theta_1$ | Gear 1 | $R_1$ | $\theta_2$ | $R_2$ |
| 0. | 1. | 17.96141301 | 1.49198681 | 12.03858699 |
| 1. | 1. | 17.96141301 | 2.983973621 | 12.03858699 |
| 2. | 1. | 17.96141301 | 4.475960431 | 12.03858699 |
| 3. | 1. | 17.96141301 | 5.967947241 | 12.03858699 |
| 4. | 1. | 17.96141301 | 7.459934052 | 12.03858699 |
| 5. | 1. | 17.96141301 | 8.951920862 | 12.03858699 |
| 6. | 1. | 17.96141301 | 10.44390767 | 12.03858699 |
| 7. | 1. | 17.96141301 | 11.93589448 | 12.03858699 |
| 8. | 1. | 17.96141301 | 13.42788129 | 12.03858699 |
| 9. | 1. | 17.96141301 | 14.9198681 | 12.03858699 |
| 10. | 1. | 17.96141301 | 16.41185491 | 12.03858699 |
| 11. | 1. | 17.96141301 | 17.90384172 | 12.03858699 |
| 12. | 1. | 17.96141301 | 19.39582853 | 12.03858699 |
| 13. | 1. | 17.96141301 | 20.88781534 | 12.03858699 |
| 14. | 1. | 17.96141301 | 22.37980215 | 12.03858699 |
| 15. | 1. | 17.96141301 | 23.87178897 | 12.03858699 |
| 16. | 1. | 17.96141301 | 25.36377578 | 12.03858699 |
| 17. | 1. | 17.96141301 | 26.85576259 | 12.03858699 |
| 18. | 1. | 17.96141301 | 28.3477494 | 12.03858699 |
| 19. | 1. | 17.96141301 | 29.83973621 | 12.03858699 |
| 20. | 1. | 17.96141301 | 31.33172302 | 12.03858699 |
| 21. | 1. | 17.96141301 | 32.82370983 | 12.03858699 |
| 22. | 1. | 17.96141301 | 34.31569664 | 12.03858699 |
| 23. | 1. | 17.96141301 | 35.80768345 | 12.03858699 |
| 24. | 1. | 17.96141301 | 37.29967026 | 12.03858699 |
| 25. | 1. | 17.96141301 | 38.79165707 | 12.03858699 |
| 26. | 1. | 17.96141301 | 40.28364388 | 12.03858699 |
| 27. | 1. | 17.95843948 | 41.77501532 | 12.04156052 |
| 28. | 1. | 17.9494876 | 43.26453602 | 12.0505124 |
| 29. | 1. | 17.93446227 | 44.75095649 | 12.06553773 |
| 30. | 1. | 17.91320062 | 46.23300314 | 12.08679938 |
| 31. | 1. | 17.88546522 | 47.70936733 | 12.11453478 |
| 32. | 1. | 17.85093341 | 49.17869283 | 12.14906659 |
| 33. | 1. | 17.80918199 | 50.63956133 | 12.19081801 |
| 34. | 1. | 17.75966524 | 52.09047469 | 12.24033476 |
| 35. | 1. | 17.70168353 | 53.52983296 | 12.29831647 |
| 36. | 1. | 17.63433785 | 54.95590603 | 12.36566215 |
| 37. | 1. | 17.55646252 | 56.36679603 | 12.44353748 |
| 38. | 1. | 17.46652229 | 57.76038548 | 12.53347771 |
| 39. | 1. | 17.36244872 | 59.13426308 | 12.63755128 |
| 40. | 1. | 17.24136579 | 60.48561194 | 12.75863421 |
| 41. | 1. | 17.09909739 | 61.81103063 | 12.90090261 |
| 42. | 1. | 16.92919857 | 63.10622272 | 13.07080143 |

TABLE I-continued

| | | APPENDIX | | |
|---|---|---|---|---|
| $\theta_1$ | Gear 1 | $R_1$ | $\theta_2$ | $R_2$ |
| 43. | 1. | 16.72078763 | 64.36539285 | 13.27921237 |
| 44. | 1. | 16.45263075 | 65.57984493 | 13.54736925 |
| 45. | 1. | 16.06998424 | 66.73346776 | 13.93001576 |
| 46. | 1. | 15. | 67.73346776 | 15. |
| 47. | 1. | 14.4133724 | 68.65819457 | 15.5866276 |
| 48. | 1. | 14.16097317 | 69.55225033 | 15.83902683 |
| 49. | 1. | 13.96468522 | 70.42312099 | 16.03531478 |
| 50. | 1. | 13.79797032 | 71.27474086 | 16.20202968 |
| 51. | 1. | 13.65052384 | 72.10966203 | 16.34947616 |
| 52. | 1. | 13.51705096 | 72.92972469 | 16.48294904 |
| 53. | 1. | 13.39440198 | 73.73634436 | 16.60559802 |
| 54. | 1. | 13.28052285 | 74.53065884 | 16.71947715 |
| 55. | 1. | 13.17398623 | 75.31361233 | 16.82601377 |
| 56. | 1. | 13.073753 | 76.08600759 | 16.926247 |
| 57. | 1. | 12.97903913 | 76.84854029 | 17.02096087 |
| 58. | 1. | 12.88923623 | 77.60182263 | 17.11076377 |
| 59. | 1. | 12.80386124 | 78.34640032 | 17.19613876 |
| 60. | 1. | 12.72252336 | 79.08276499 | 17.27747664 |
| 61. | 1. | 12.64490138 | 79.81136364 | 17.35509862 |
| 62. | 1. | 12.57072777 | 80.5326059 | 17.42927223 |
| 63. | 1. | 12.49977709 | 81.24686978 | 17.50022291 |
| 64. | 1. | 12.43185749 | 81.9545062 | 17.56814251 |
| 65. | 1. | 12.36680428 | 82.65584273 | 17.63319572 |
| 66. | 1. | 12.30447502 | 83.35118661 | 17.69552498 |
| 67. | 1. | 12.24474567 | 84.04082729 | 17.75525433 |
| 68. | 1. | 12.18750757 | 84.72503853 | 17.81249243 |
| 69. | 1. | 12.13266505 | 85.40408021 | 17.86733495 |
| 70. | 1. | 12.08013344 | 86.07819982 | 17.91986656 |
| 71. | 1. | 12.02983756 | 86.74763381 | 17.97016244 |
| 72. | 1. | 11.98171033 | 87.4126087 | 18.01828967 |
| 73. | 1. | 11.93569176 | 88.0733421 | 18.06430824 |
| 74. | 1. | 11.89172804 | 88.73004353 | 18.10827196 |
| 75. | 1. | 11.84977073 | 89.38291521 | 18.15022927 |
| 76. | 1. | 11.80977619 | 90.03215275 | 18.19022381 |
| 77. | 1. | 11.77170501 | 90.67794574 | 18.22829499 |
| 78. | 1. | 11.73552151 | 91.32047826 | 18.26447849 |
| 79. | 1. | 11.70119342 | 91.95992944 | 18.29880658 |
| 80. | 1. | 11.66869145 | 92.59647382 | 18.33130855 |
| 81. | 1. | 11.63798904 | 93.2302818 | 18.36201096 |
| 82. | 1. | 11.60906212 | 93.86151998 | 18.39093788 |
| 83. | 1. | 11.58188883 | 94.4903515 | 18.41811117 |
| 84. | 1. | 11.55644937 | 95.11693635 | 18.44355063 |
| 85. | 1. | 11.5327258 | 95.74143164 | 18.4672742 |
| 86. | 1. | 11.5107019 | 96.36399188 | 18.4892981 |
| 87. | 1. | 11.49036306 | 96.98476922 | 18.50963694 |
| 88. | 1. | 11.47169612 | 97.60391364 | 18.52830388 |
| 89. | 1. | 11.4546893 | 98.22157325 | 18.5453107 |
| 90. | 1. | 11.43933211 | 98.8378944 | 18.56066789 |
| 91. | 1. | 11.42561526 | 99.45302192 | 18.57438474 |
| 92. | 1. | 11.41353062 | 100.0670993 | 18.58646938 |
| 93. | 1. | 11.40307112 | 100.6802689 | 18.59692888 |
| 94. | 1. | 11.39423074 | 101.292672 | 18.60576926 |
| 95. | 1. | 11.38700445 | 101.9044491 | 18.61299555 |
| 96. | 1. | 11.38138817 | 102.51574 | 18.61861183 |
| 97. | 1. | 11.37737876 | 103.126684 | 18.62262124 |
| 98. | 1. | 11.37497401 | 103.73742 | 18.62502599 |
| 99. | 1. | 11.37417257 | 104.3480867 | 18.62582743 |
| 100. | 1. | 11.37497401 | 104.9588227 | 18.62502599 |
| 101. | 1. | 11.37737876 | 105.5697667 | 18.62262124 |
| 102. | 1. | 11.38138817 | 106.1810576 | 18.61861183 |
| 103. | 1. | 11.38700445 | 106.7928347 | 18.61299555 |
| 104. | 1. | 11.39423074 | 107.4052378 | 18.60576926 |
| 105. | 1. | 11.40307112 | 108.0184074 | 18.59692888 |
| 106. | 1. | 11.41353062 | 108.6324848 | 18.58646938 |
| 107. | 1. | 11.42561526 | 109.2476123 | 18.57438474 |
| 108. | 1. | 11.43933211 | 109.8639335 | 18.56066789 |
| 109. | 1. | 11.4546893 | 110.4815931 | 18.5453107 |
| 110. | 1. | 11.47169612 | 111.1007375 | 18.52830388 |
| 111. | 1. | 11.49036306 | 111.7215148 | 18.50963694 |
| 112. | 1. | 11.5107019 | 112.3440751 | 18.4892981 |
| 113. | 1. | 11.5327258 | 112.9685704 | 18.4672742 |
| 114. | 1. | 11.55644937 | 113.5951552 | 18.44355063 |
| 115. | 1. | 11.58188883 | 114.2239867 | 18.41811117 |
| 116. | 1. | 11.60906212 | 114.8552249 | 18.39093788 |
| 117. | 1. | 11.63798904 | 115.4890329 | 18.36201096 |
| 118. | 1. | 11.66869145 | 116.1255773 | 18.33130855 |
| 119. | 1. | 11.70119342 | 116.7650285 | 18.29880658 |
| 120. | 1. | 11.73552151 | 117.407561 | 18.26447879 |
| 121. | 1. | 11.77170501 | 118.053354 | 18.22829499 |

TABLE I-continued

| | | APPENDIX | | |
|---|---|---|---|---|
| $\theta_1$ | Gear 1 | $R_1$ | $\theta_2$ | $R_2$ |
| 122. | 1. | 11.80977619 | 118.7025915 | 18.19022381 |
| 123. | 1. | 11.84977073 | 119.3554632 | 18.15022927 |
| 124. | 1. | 11.89172804 | 120.0121646 | 18.10827196 |
| 125. | 1. | 11.93569176 | 120.672898 | 18.06430824 |
| 126. | 1. | 11.98171033 | 121.3378729 | 18.01828967 |
| 127. | 1. | 12.02983756 | 122.0073069 | 17.97016244 |
| 128. | 1. | 12.08013344 | 122.6814265 | 17.91986656 |
| 129. | 1. | 12.13266505 | 123.3604682 | 17.86733495 |
| 130. | 1. | 12.18750757 | 124.0446794 | 17.81249243 |
| 131. | 1. | 12.24474567 | 124.7343201 | 17.75525433 |
| 132. | 1. | 12.30447502 | 125.429664 | 17.69552498 |
| 133. | 1. | 12.36680428 | 126.1310005 | 17.63319572 |
| 134. | 1. | 12.43185749 | 126.8386369 | 17.56814251 |
| 135. | 1. | 12.49977709 | 127.5529008 | 17.50022291 |
| 136. | 1. | 12.57072777 | 128.2741431 | 17.42927223 |
| 137. | 1. | 12.64490138 | 129.0027417 | 17.35509862 |
| 138. | 1. | 12.72252336 | 129.7391064 | 17.27747664 |
| 139. | 1. | 12.80386124 | 130.4836841 | 17.19613876 |
| 140. | 1. | 12.88923623 | 131.2369664 | 17.11076377 |
| 141. | 1. | 12.97903913 | 131.9994991 | 17.02096087 |
| 142. | 1. | 13.073753 | 132.7718944 | 16.926247 |
| 143. | 1. | 13.17398623 | 133.5548479 | 16.82601377 |
| 144. | 1. | 13.28052285 | 134.3491624 | 16.71947715 |
| 145. | 1. | 13.39440198 | 135.155782 | 16.60559802 |
| 146. | 1. | 13.51705096 | 135.9758447 | 16.48294904 |
| 147. | 1. | 13.65052384 | 136.8107659 | 16.34947616 |
| 148. | 1. | 13.79797032 | 137.6623857 | 16.20202968 |
| 149. | 1. | 13.96468522 | 138.5332564 | 16.03531478 |
| 150. | 1. | 14.16097317 | 139.4273121 | 15.83902683 |
| 151. | 1. | 14.4133724 | 140.352039 | 15.5866276 |
| 152. | 1. | 15. | 141.352039 | 15. |
| 153. | 1. | 16.06998424 | 142.5056618 | 13.93001576 |
| 154. | 1. | 16.45263075 | 143.7201139 | 13.54736925 |
| 155. | 1. | 16.72078763 | 144.979284 | 13.27921237 |
| 156. | 1. | 16.92919857 | 146.2744761 | 13.07080143 |
| 157. | 1. | 17.09909739 | 147.5998948 | 12.90090261 |
| 158. | 1. | 17.24136579 | 148.9512436 | 12.75863421 |
| 159. | 1. | 17.36244872 | 150.3251212 | 12.63755128 |
| 160. | 1. | 17.46652229 | 151.7187107 | 12.53347771 |
| 161. | 1. | 17.55646252 | 153.1296007 | 12.44353748 |
| 162. | 1. | 17.63433785 | 154.5556738 | 12.36566215 |
| 163. | 1. | 17.70168353 | 155.995032 | 12.29831647 |
| 164. | 1. | 17.75966524 | 157.4459454 | 12.24033476 |
| 165. | 1. | 17.80918199 | 158.9068139 | 12.19081801 |
| 166. | 1. | 17.85093341 | 160.3761394 | 12.14906659 |
| 167. | 1. | 17.88546522 | 161.8525036 | 12.11453478 |
| 168. | 1. | 17.91320062 | 163.3345502 | 12.08679938 |
| 169. | 1. | 17.93446227 | 164.8209707 | 12.06553773 |
| 170. | 1. | 17.9494876 | 166.3104914 | 12.0505124 |
| 171. | 1. | 17.95843948 | 167.8018628 | 12.04156052 |
| 172. | 1. | 17.96141301 | 169.2938496 | 12.03858699 |
| 173. | 1. | 17.96141301 | 170.7858365 | 12.03858699 |
| 174. | 1. | 17.96141301 | 172.2778233 | 12.03858699 |
| 175. | 1. | 17.96141301 | 173.7698101 | 12.03858699 |
| 176. | 1. | 17.96141301 | 175.2617969 | 12.03858699 |
| 177. | 1. | 17.96141301 | 176.7537837 | 12.03858699 |
| 178. | 1. | 17.96141301 | 178.2457705 | 12.03858699 |
| 179. | 1. | 17.96141301 | 179.7377573 | 12.03858699 |
| 180. | 1. | 17.96141301 | 181.2297441 | 12.03858699 |
| 181. | 1. | 17.96141301 | 182.7217309 | 12.03858699 |
| 182. | 1. | 17.96141301 | 184.2137178 | 12.03858699 |
| 183. | 1. | 17.96141301 | 185.7057046 | 12.03858699 |
| 184. | 1. | 17.96141301 | 187.1976914 | 12.03858699 |
| 185. | 1. | 17.96141301 | 188.6896782 | 12.03858699 |
| 186. | 1. | 17.96141301 | 190.181665 | 12.03858699 |
| 187. | 1. | 17.96141301 | 191.6736518 | 12.03858699 |
| 188. | 1. | 17.96141301 | 193.1656386 | 12.03858699 |
| 189. | 1. | 17.96141301 | 194.6576254 | 12.03858699 |
| 190. | 1. | 17.96141301 | 196.1496122 | 12.03858699 |
| 191. | 1. | 17.96141301 | 197.641599 | 12.03858699 |
| 192. | 1. | 17.96141301 | 199.1335859 | 12.03858699 |
| 193. | 1. | 17.96141301 | 200.6255727 | 12.03858699 |
| 194. | 1. | 17.96141301 | 202.1175595 | 12.03858699 |
| 195. | 1. | 17.96141301 | 203.6095463 | 12.03858699 |
| 196. | 1. | 17.96141301 | 205.1015331 | 12.03858699 |
| 197. | 1. | 17.96141301 | 206.5935199 | 12.03858699 |
| 198. | 1. | 17.96141301 | 208.0855067 | 12.03858699 |
| 199. | 1. | 17.96141301 | 209.5774935 | 12.03858699 |
| 200. | 1. | 17.96141301 | 211.0694803 | 12.03858699 |

TABLE I-continued

| | | APPENDIX | | |
|---|---|---|---|---|
| $\theta_1$ | Gear 1 | $R_1$ | $\theta_2$ | $R_2$ |
| 201. | 1. | 17.96141301 | 212.5614671 | 12.03858699 |
| 202. | 1. | 17.96141301 | 214.053454 | 12.03858699 |
| 203. | 1. | 17.96141301 | 215.5454408 | 12.03858699 |
| 204. | 1. | 17.96141301 | 217.0374276 | 12.03858699 |
| 205. | 1. | 17.96141301 | 218.5294144 | 12.03858699 |
| 206. | 1. | 17.96141301 | 220.0214012 | 12.03858699 |
| 207. | 1. | 17.96141301 | 221.513388 | 12.03858699 |
| 208. | 1. | 17.96141301 | 223.0053748 | 12.03858699 |
| 209. | 1. | 17.96141301 | 224.4973616 | 12.03858699 |
| 210. | 1. | 17.96141301 | 225.9893484 | 12.03858699 |
| 211. | 1. | 17.96141301 | 227.4813352 | 12.03858699 |
| 212. | 1. | 17.96141301 | 228.9733221 | 12.03858699 |
| 213. | 1. | 17.96141301 | 230.4653089 | 12.03858699 |
| 214. | 1. | 17.96141301 | 231.9572957 | 12.03858699 |
| 215. | 1. | 17.96141301 | 233.4492825 | 12.03858699 |
| 216. | 1. | 17.96141301 | 234.9412693 | 12.03858699 |
| 217. | 1. | 17.96141301 | 236.4332561 | 12.03858699 |
| 218. | 1. | 17.96141301 | 237.9252429 | 12.03858699 |
| 219. | 1. | 17.96141301 | 239.4172297 | 12.03858699 |
| 220. | 1. | 17.96141301 | 240.9092165 | 12.03858699 |
| 221. | 1. | 17.95843948 | 242.400588 | 12.04156052 |
| 222. | 1. | 17.9494876 | 243.8901087 | 12.0505124 |
| 223. | 1. | 17.93446227 | 245.3765291 | 12.06553773 |
| 224. | 1. | 17.91320062 | 246.8585758 | 12.08679938 |
| 225. | 1. | 17.88546522 | 248.33494 | 12.11453478 |
| 226. | 1. | 17.85093341 | 249.8042655 | 12.14906659 |
| 227. | 1. | 17.80918199 | 251.265134 | 12.19081801 |
| 228. | 1. | 17.75966524 | 252.7160473 | 12.24033476 |
| 229. | 1. | 17.70168353 | 254.1554056 | 12.29831647 |
| 230. | 1. | 17.63433785 | 255.5814787 | 12.36566215 |
| 231. | 1. | 17.55646252 | 256.9923687 | 12.44353748 |
| 232. | 1. | 17.46652229 | 258.3859581 | 12.53347771 |
| 233. | 1. | 17.36244872 | 259.7598357 | 12.63755128 |
| 234. | 1. | 17.24136579 | 261.1111846 | 12.75863421 |
| 235. | 1. | 17.09909739 | 262.4366033 | 12.90090261 |
| 236. | 1. | 16.92919857 | 263.7317954 | 13.07080143 |
| 237. | 1. | 16.72078763 | 264.9909655 | 13.27921237 |
| 238. | 1. | 16.45263075 | 266.2054176 | 13.54736925 |
| 239. | 1. | 16.06998424 | 267.3590404 | 13.93001576 |
| 240. | 1. | 15. | 268.3590404 | 15. |
| 241. | 1. | 14.30598452 | 269.2705971 | 15.69401548 |
| 242. | 1. | 14.00473934 | 270.1461527 | 15.99526066 |
| 243. | 1. | 13.76945629 | 270.9945196 | 16.23054371 |
| 244. | 1. | 13.56897309 | 271.8203336 | 16.43102691 |
| 245. | 1. | 13.39119801 | 272.6266048 | 16.60880199 |
| 246. | 1. | 13.22992331 | 273.4155054 | 16.77007669 |
| 247. | 1. | 13.08146 | 274.188708 | 16.91854 |
| 248. | 1. | 12.94340527 | 274.9475585 | 17.05659473 |
| 249. | 1. | 12.8140918 | 275.6931747 | 17.1859082 |
| 250. | 1. | 12.69230769 | 276.4265081 | 17.30769231 |
| 251. | 1. | 12.5771403 | 277.1483838 | 17.4228597 |
| 252. | 1. | 12.46788278 | 277.8595291 | 17.53211722 |
| 253. | 1. | 12.36397525 | 278.5605927 | 17.63602475 |
| 254. | 1. | 12.26496585 | 279.2521598 | 17.73503415 |
| 255. | 1. | 12.1704842 | 279.934763 | 17.8295158 |
| 256. | 1. | 12.08022273 | 280.608891 | 17.91977727 |
| 257. | 1. | 11.99392308 | 281.2749951 | 18.00607692 |
| 258. | 1. | 11.91136614 | 281.9334952 | 18.08863386 |
| 259. | 1. | 11.83236452 | 282.5847833 | 18.16763548 |
| 260. | 1. | 11.75675676 | 283.2292277 | 18.24324324 |
| 261. | 1. | 11.68440285 | 283.8671759 | 18.31559715 |
| 262. | 1. | 11.6151807 | 284.498957 | 18.3848193 |
| 263. | 1. | 11.54898327 | 285.1248837 | 18.45101673 |
| 264. | 1. | 11.48571635 | 285.7452542 | 18.51428365 |
| 265. | 1. | 11.42529668 | 286.360354 | 18.57470332 |
| 266. | 1. | 11.36765042 | 286.9704569 | 18.63234958 |
| 267. | 1. | 11.31271187 | 287.5758263 | 18.68728813 |
| 268. | 1. | 11.26042247 | 288.1767162 | 18.73957753 |
| 269. | 1. | 11.21072989 | 288.7733721 | 18.78927011 |
| 270. | 1. | 11.16358723 | 289.3660321 | 18.83641277 |
| 271. | 1. | 11.11895249 | 289.954927 | 18.88104751 |
| 272. | 1. | 11.07678794 | 290.5402815 | 18.9231206 |
| 273. | 1. | 11.03705969 | 291.1223146 | 18.96294031 |
| 274. | 1. | 10.99973729 | 291.7012402 | 19.00026271 |
| 275. | 1. | 10.96479638 | 292.2772672 | 19.03520662 |
| 276. | 1. | 10.93220339 | 292.8506005 | 19.0677966 |
| 277. | 1. | 10.9019453 | 293.4214412 | 19.0980547 |
| 278. | 1. | 10.87399937 | 293.9899865 | 19.12600063 |
| 279. | 1. | 10.84834798 | 294.556431 | 19.15165202 |

TABLE I-continued

| | | APPENDIX | | |
|---|---|---|---|---|
| $\theta_1$ | Gear 1 | $R_1$ | $\theta_2$ | $R_2$ |
| 280. | 1. | 10.82497548 | 295.1209662 | 19.17502452 |
| 281. | 1. | 10.80386798 | 295.683781 | 19.19613202 |
| 282. | 1. | 10.78501326 | 296.2450624 | 19.21498674 |
| 283. | 1. | 10.76840067 | 296.804995 | 19.23159933 |
| 284. | 1. | 10.75402101 | 297.3637622 | 19.24597899 |
| 285. | 1. | 10.74186646 | 297.9215456 | 19.25813354 |
| 286. | 1. | 10.73193052 | 298.4785256 | 19.26806948 |
| 287. | 1. | 10.72420792 | 299.0348819 | 19.27579208 |
| 288. | 1. | 10.71869464 | 299.5907931 | 19.28130536 |
| 289. | 1. | 10.71538781 | 300.1464376 | 19.28461219 |
| 290. | 1. | 10.71428572 | 300.7019932 | 19.28571428 |
| 291. | 1. | 10.71538781 | 301.2576376 | 19.28461219 |
| 292. | 1. | 10.71869464 | 301.8135489 | 19.28130536 |
| 293. | 1. | 10.72420792 | 302.3699051 | 19.27579208 |
| 294. | 1. | 10.73193052 | 302.9268852 | 19.26806948 |
| 295. | 1. | 10.74186646 | 303.4846686 | 19.25813354 |
| 296. | 1. | 10.75402101 | 304.0434357 | 19.24597899 |
| 297. | 1. | 10.76840067 | 304.6033684 | 19.23159993 |
| 298. | 1. | 10.78501326 | 305.1646497 | 19.21498674 |
| 299. | 1. | 10.80386798 | 305.7274646 | 19.19613202 |
| 300. | 1. | 10.82497548 | 306.2919997 | 19.17502452 |
| 301. | 1. | 10.84834798 | 306.8584442 | 19.15165202 |
| 302. | 1. | 10.87399937 | 307.4269896 | 19.12600063 |
| 303. | 1. | 10.9019453 | 307.9978302 | 19.0980547 |
| 304. | 1. | 10.93220339 | 308.5711635 | 19.0677966 |
| 305. | 1. | 10.96479338 | 309.14711906 | 19.03520662 |
| 306. | 1. | 10.99973729 | 309.72611161 | 19.00026271 |
| 307. | 1. | 11.03705969 | 310.3081492 | 18.96294031 |
| 308. | 1. | 11.07678794 | 310.8935038 | 18.92321206 |
| 309. | 1. | 11.11895249 | 311.4823987 | 18.88104751 |
| 310. | 1. | 11.16358723 | 312.0750586 | 18.83641277 |
| 311. | 1. | 11.21072989 | 312.6717146 | 18.78927011 |
| 312. | 1. | 11.26042247 | 313.2726044 | 18.73957753 |
| 313. | 1. | 11.31271187 | 313.8779738 | 18.68728813 |
| 314. | 1. | 11.36765042 | 314.4880767 | 18.63234958 |
| 315. | 1. | 11.42529668 | 315.1031765 | 18.57470332 |
| 316. | 1. | 11.48571635 | 315.7235471 | 18.51428365 |
| 317. | 1. | 11.54898327 | 316.3494737 | 18.45101673 |
| 318. | 1. | 11.6151807 | 316.9812548 | 18.3848193 |
| 319. | 1. | 11.68440285 | 317.619203 | 18.31559715 |
| 320. | 1. | 11.75675676 | 318.2636475 | 18.24324324 |
| 321. | 1. | 11.83236452 | 318.9149356 | 18.16763548 |
| 322. | 1. | 11.91136614 | 319.5734356 | 18.08863386 |
| 323. | 1. | 11.99392308 | 320.2395398 | 18.00607692 |
| 324. | 1. | 12.08022273 | 320.9136677 | 17.91977727 |
| 325. | 1. | 12.1704842 | 321.5962709 | 17.8295158 |
| 326. | 1. | 12.26496585 | 322.287838 | 17.73503415 |
| 327. | 1. | 12.36397525 | 322.9889016 | 17.63602475 |
| 328. | 1. | 12.46788278 | 323.7000469 | 17.53211722 |
| 329. | 1. | 12.5771403 | 324.4219227 | 17.4228597 |
| 330. | 1. | 12.69230769 | 325.155256 | 17.30769231 |
| 331. | 1. | 12.8140918 | 325.9008722 | 17.1859082 |
| 332. | 1. | 12.94340527 | 326.6597227 | 17.05659473 |
| 333. | 1. | 13.08146 | 327.4329254 | 16.91854 |
| 334. | 1. | 13.22992331 | 328.221826 | 16.77007669 |
| 335. | 1. | 13.39119801 | 329.0280971 | 16.60880199 |
| 336. | 1. | 13.56897309 | 329.8539112 | 16.43102691 |
| 337. | 1. | 13.76945629 | 330.7022781 | 16.23054371 |
| 338. | 1. | 14.00473934 | 331.5778337 | 15.99526066 |
| 339. | 1. | 14.30598452 | 332.4893903 | 15.69401548 |
| 340. | 1. | 15. | 333.4893903 | 15. |
| 341. | 1. | 16.06998424 | 334.6430132 | 13.93001576 |
| 342. | 1. | 16.45263075 | 335.8574652 | 13.54736925 |
| 343. | 1. | 16.72078763 | 337.1166354 | 13.27921237 |
| 344. | 1. | 16.92919857 | 338.4118275 | 13.07080143 |
| 345. | 1. | 17.09909739 | 339.7372461 | 12.90090261 |
| 346. | 1. | 17.24136579 | 341.088595 | 12.75863421 |
| 347. | 1. | 17.36244872 | 342.4624726 | 12.63755128 |
| 348. | 1. | 17.46652229 | 343.8560621 | 12.53347771 |
| 349. | 1. | 17.55646252 | 345.2669521 | 12.44353748 |
| 350. | 1. | 17.63433785 | 346.6930251 | 12.36566215 |
| 351. | 1. | 17.70168353 | 348.1323834 | 12.29831647 |
| 352. | 1. | 17.75966524 | 349.5832968 | 12.24033476 |
| 353. | 1. | 17.80918199 | 351.0441653 | 12.19081801 |

TABLE I-continued

| | | APPENDIX | | |
|---|---|---|---|---|
| $\theta_1$ | Gear 1 | $R_1$ | $\theta_2$ | $R_2$ |
| 354. | 1. | 17.85093341 | 352.5134908 | 12.14906659 |
| 355. | 1. | 17.88546522 | 353.9898549 | 12.11453478 |
| 356. | 1. | 17.91320062 | 355.4719016 | 12.08679938 |
| 357. | 1. | 17.93446227 | 356.9583221 | 12.06553773 |
| 358. | 1. | 17.9494876 | 358.4478428 | 12.0505124 |
| 359. | 1. | 17.95843948 | 359.9392142 | 12.04156052 |

Having thus described our invention with reference to a preferred embodiment thereof and described the theory and improvements of operation thereof, it will be obvious to those of skill in the art that numerous specific design factors may be modified without departing from the spirit and scope which comprise the essence thereof. Therefore, the following claims are intended to be viewed in part as description rather than limitation.

Having thus described our invention, what we desire to protect by Letters Patent is:

1. A dot printer comprising:

at least one printing element;

a unitary suspension spring and frame element upon which said printing element is affixed;

a platen, said platen being arranged adjacent to and parallel with said frame element on which said printing element is affixed;

said suspension spring and frame element comprising at least two comb like shaped plate springs having first, second and third legs, respectively, said first and third legs being the extreme legs and being connected to said frame forming a unitary piece therewith, said second legs thereof being rigidly mounted to a fixed location in said printer to support said comb like shaped plate springs generally orthogonal to an intended print line and parallel with each other;

said printing element being affixed to said frame element at a position approximately colinear with the extreme first or third legs of said comb like shaped plate springs which are nearest to said print line;

a reciprocating drive means for causing linear reciprocation without orthogonal or off axis forces, said drive means being connected to said frame element and arranged with respect thereto for reciprocating the same;

said reciprocating drive means comprising a uniformly rotating electrical motor coupled to a meshed set of non-circular gears for rotating said gears, at least one of said gears providing on an output shaft a non-uniform rotational velocity;

a matched circular set of meshed gears each having a pivot on an exposed face thereof at a fixed radial distance from the rotational axis thereof and one of said gears being connected to receive said non-uniform rotational velocity from said output shaft of said non-circular gears;

a flexible plastic yoke and drive link in the approximate shape of a "V" with the ends of said "V" being pivotally connected to said pivots on said matched circular set of gears and the point of said "V" being connected to said frame for applying reciprocal linear motion thereto as said circular gears are rotated, said motion acting along the plane parallel to the axes of said circular gear set and bisecting the distance between said axes.

* * * * *